US011779095B2

(12) United States Patent
Byeon

(10) Patent No.: US 11,779,095 B2
(45) Date of Patent: Oct. 10, 2023

(54) CONTAINER FOR STICK TYPE CONTENT

(71) Applicant: KR CO., LTD., Bucheon-si (KR)

(72) Inventor: Jae Sam Byeon, Gyeonggi-do (KR)

(73) Assignee: KR CO., LTD., Bucheon-si (KR)

( * ) Notice: Subject to any disclaimer, the term of this patent is extended or adjusted under 35 U.S.C. 154(b) by 67 days.

(21) Appl. No.: 17/546,734

(22) Filed: Dec. 9, 2021

(65) Prior Publication Data

US 2023/0180916 A1 Jun. 15, 2023

(51) Int. Cl.

| | |
|---|---|
| ***A45D 40/06*** | (2006.01) |
| ***A45D 40/04*** | (2006.01) |
| ***A45D 40/00*** | (2006.01) |
| ***A45D 40/14*** | (2006.01) |

(52) U.S. Cl.

CPC ..... *A45D 40/06* (2013.01); *A45D 40/04* (2013.01); *A45D 40/14* (2013.01); *A45D 2040/0006* (2013.01); *A45D 2040/0025* (2013.01)

(58) Field of Classification Search

CPC ..... A45D 40/04; A45D 2040/0025; A45D 2040/0006; A45D 40/14; B65D 83/0005; B65D 83/0011

USPC ..... 401/68, 69, 75, 172, 174

See application file for complete search history.

(56) References Cited

U.S. PATENT DOCUMENTS

2005/0163554 A1* 7/2005 Cara Sanchez ..... A45D 40/04 401/75
2010/0272494 A1* 10/2010 Kokai ..... A45D 40/04 401/68

FOREIGN PATENT DOCUMENTS

| | | | |
|---|---|---|---|
| JP | H08-150019 | A | 6/1996 |
| JP | 4908047 | B2 | 4/2012 |
| JP | 2016-077781 | A | 5/2016 |
| JP | 2016-083098 | A | 5/2016 |
| JP | 2019-097824 | A | 6/2019 |
| KR | 10-2001-0010351 | A | 2/2001 |
| KR | 10-2001-0017834 | A | 3/2001 |
| KR | 10-1859186 | B1 | 5/2018 |

* cited by examiner

*Primary Examiner* — David J Walczak
(74) *Attorney, Agent, or Firm* — Bridgeway IP Law Group, PLLC; Sang Ho Lee; Hyun Woo Shin

(57) ABSTRACT

A container for stick type content includes a housing, a manipulation portion coupled to a lower side of the housing to be relatively rotatable with the housing, a first lifting portion provided inside the housing and including an accommodation portion on top in which at least a part of content is accommodated, and a second lifting portion provided inside the first lifting portion and including a support portion disposed inside the accommodation portion to support the content from below. The first lifting portion and the second lifting portion move upward or downward according to rotation of the manipulation portion, and the first lifting portion and the second lifting portion move upward simultaneously and move the content upward when the manipulation portion rotates in one direction while the second lifting portion moves upward alone and moves the content further upward when the first lifting portion moves upward to a certain height.

16 Claims, 16 Drawing Sheets

CONTAINER FOR STICK TYPE CONTENT

STATEMENT REGARDING PRIOR DISCLOSURES BY THE INVENTOR(S)

The following disclosure is submitted under 35 U.S.C. 102(b)(1)(A) as a prior disclosure by, or on behalf of, the inventor(s) of the present application: Korean patent application publication No. KR 10-2021-0112979 published on Sep. 15, 2021, the entire disclosure of which is hereby incorporated by reference.

BACKGROUND

1. Field of the Invention

The present disclosure relates to a container for stick type content and, more particularly, to a container for stick type content which allows the content to be used without a residue through a two-step structure.

2. Discussion of Related Art

Generally, cosmetic containers have structures configured to accommodate a variety of types of cosmetics and to withdraw cosmetics to transfer cosmetics to a particular region of a body while structures of cosmetic containers depend on properties of cosmetics accommodated in containers.

As an example, in the case of solid cosmetics capable of maintaining a certain stick type such as a lipstick, a sun stick, sun balm, and the like, cosmetic containers may include a quadrangular or circular plate configured to partially accommodate a lower side of stick type cosmetics therein and to support the lower side of the cosmetics and may implement withdrawal of cosmetics by lifting the plate. In detail, conventional containers for stick type cosmetics may include an outer container and an inner container (or a rotation manipulation portion) provided to be relatively rotatable and have a structure in which, when a user holds the outer container and turns the inner container (or the rotation manipulation portion) exposed downward, a plate moves upward and thus stick type cosmetics move upward to be exposed outward.

However, in the case of conventional containers for stick type cosmetics with the structure, since it is difficult to completely expose and use cosmetics due to a height or the like of the plate supporting cosmetics, a residue is left that is necessarily not used.

Accordingly, to overcome the limitation, a novel container is required.

SUMMARY OF THE INVENTION

The present disclosure is directed to providing a container for stick type content capable of using content without a residue through a two-step lift structure.

It should be noted that objects of the present disclosure are not limited to the above-described objects, and other objects of the present disclosure will be apparent to those skilled in the art from the following descriptions.

According to an aspect of the present disclosure, there is provided a container for stick type content. The container for stick type content includes a housing having an outlet formed in an upper side, a manipulation portion coupled to a lower side of the housing to be relatively rotatable with the housing, a first lifting portion provided inside the housing and including an accommodation portion on top in which at least a part of content is accommodated, and a second lifting portion provided inside the first lifting portion and including a support portion on top and disposed inside the accommodation portion to support the content from below. Here, the first lifting portion and the second lifting portion move upward or downward according to rotation of the manipulation portion, and the first lifting portion and the second lifting portion move upward simultaneously and move the content upward when the manipulation portion rotates in one direction while the second lifting portion alone moves upward and moves the content further upward when the first lifting portion moves upward to a certain height.

The first lifting portion and the second lifting portion may be coupled to be synchronously rotatable.

The accommodation portion may include one or more fixing protrusions protruding inward from an inner surface of the accommodation portion while formed to have a certain length in a vertical direction, and the support portion may include one or more incised grooves along a periphery thereof. Also, the fixing protrusions may be inserted into the corresponding incised grooves so that the first lifting portion and the second lifting portion may be coupled to be synchronously rotatable.

A first guide protrusion may be formed on an outer surface of the first lifting portion. A second guide protrusion may be formed on an outer surface of the second lifting portion. Here, the manipulation portion may include a first lift pipe disposed to surround at least a part of the first lifting portion and including one or more first lift protrusions formed on an inner surface and may include a second lift pipe disposed between the first lifting portion and the second lifting portion to surround at least a part of the second lifting portion and including one or more second lift protrusions formed on an inner surface. Also, according to rotation of the manipulation portion, the first lift protrusions may move along the first guide protrusion and lift the first lifting portion, and the second lift protrusions may move along the second guide protrusion and lift the second lifting portion.

The manipulation portion may include a rotation portion coupled to a lower side of the housing and configured to relatively rotate with respect to the housing by a user, a first driving portion coupled to an inside of the rotation portion to be synchronously rotatable and including the first lift pipe, and a second driving portion coupled to the inside of the rotation portion to be synchronously rotatable and including the second lift pipe inserted into the first lift pipe.

The first driving portion may include a first base portion in which one or more first coupling protrusions are formed along an outer surface below the first lift pipe, and one or more second coupling protrusions are formed along an inner surface of the rotation portion. Also, the first coupling protrusions and the second coupling protrusions may be engaged with each other so that the first driving portion and the rotation portion may be coupled to be synchronously rotatable.

The second driving portion may include a second base portion formed outside a lower end of the first lift pipe, and one or more pressurizing protrusions are formed along an inner surface of the rotation portion. Also, the pressurizing protrusions may pressurize an outer surface of the second base portion so that the second driving portion and the rotation portion may be coupled to be synchronously rotatable.

One or more restriction protrusions configured to restrict an upward movement height of the first lifting portion may be formed at positions spaced downward at a certain distance apart from a lower end of the first guide protrusion below the first lifting portion.

The first lifting portion may include a first load portion extending toward a lower side of the accommodation portion, including the first guide protrusion formed on an outer surface, and at least partially accommodated inside the first lift pipe. Also, the second lifting portion may include a second load portion extending toward a lower side of the support portion, including the second guide protrusion formed on an outer surface, and at least partially accommodated inside the second lift pipe.

One or more first lift protrusions may be formed on an inner surface of the first lifting portion. Here, the manipulation portion may include a lift pipe disposed inside the first lifting portion to surround the second lifting portion and including a first guide protrusion formed on an outer surface and one or more second lift protrusions formed on an inner surface. A second guide protrusion may be formed on an outer surface of the second lifting portion. According to rotation of the manipulation portion, the first lift protrusions may move along the first guide protrusion and lift the first lifting portion, and the second lift protrusions may move along the second guide protrusion and lift the second lifting portion.

When the first lift protrusions are separated from an upper end of the first guide protrusion according to rotation of the manipulation portion in one direction, only the second lift protrusions may move further along the second guide protrusion and move the second lifting portion alone upward.

A first restriction protrusion spaced upward apart from an upper end of the first guide protrusion and configured to prevent separation of the first lifting portion may be formed on an external upper end of the lift pipe along an outer circumferential surface.

A second restriction protrusion may be further formed on the external upper end of the lift pipe along the outer circumferential surface to be at least partially overlapped with the upper end of the first guide protrusion. Here, the second restriction protrusion may be disposed below the first restriction protrusion to be spaced apart therefrom. Also, according to rotation of the manipulation portion in the first direction, the first lift protrusions may move along the first guide protrusion and cross the second restriction protrusion to relatively rotate with the manipulation portion in a space between the first restriction protrusion and the second restriction protrusion, and the second lift protrusions may move further along the second guide protrusion and lift the second lifting portion alone.

The second restriction protrusion may be formed to have a protruding height lower than the first guide protrusion.

The first lifting portion may include a first load portion extending toward a lower side of the accommodation portion, including the first lift protrusions formed on an inner surface, and at least partially accommodating the lift pipe thereinside. Also, the second lifting portion may include a second load portion extending toward a lower side of the support portion, including the second guide protrusion formed on an outer surface, and at least partially accommodated inside the lift pipe.

The manipulation portion may include a rotation portion coupled to a lower side of the housing and configured to relatively rotate with respect to the housing according to manipulation of the user and a driving portion coupled to an inside of the rotation portion to be synchronously rotatable and in which the lift pipe is formed.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
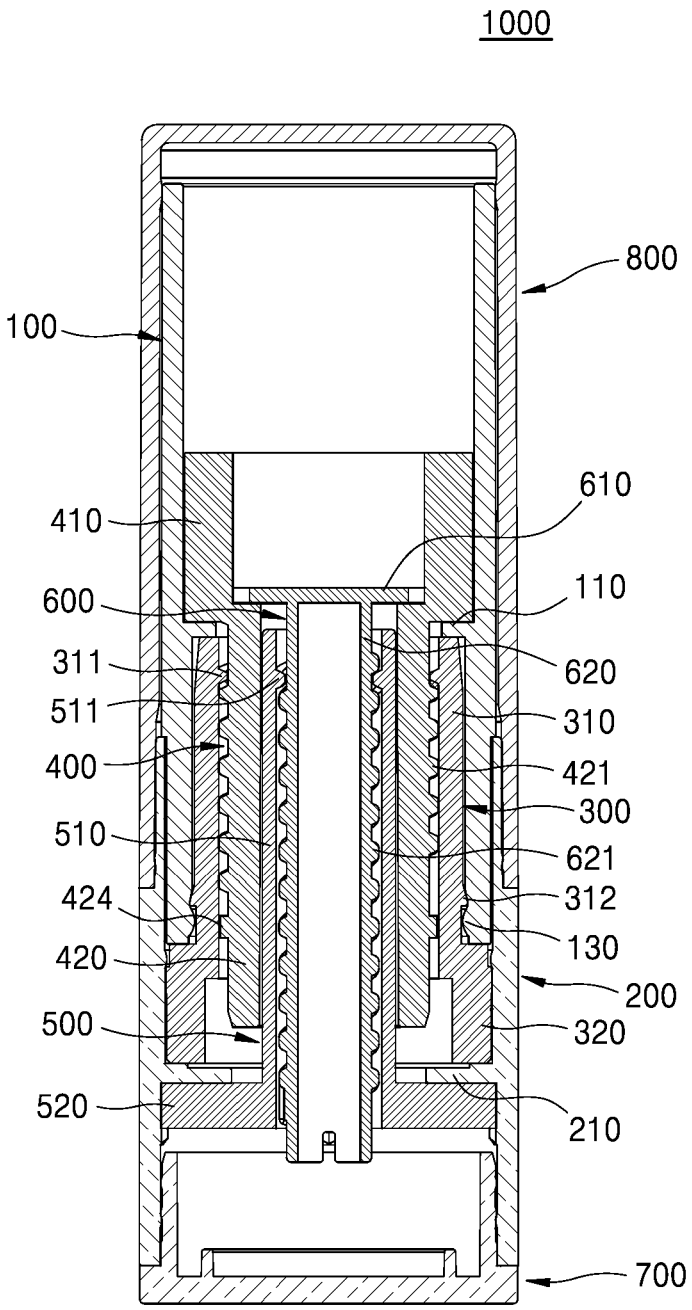
FIGS. 1 and 2 illustrate a container for stick type content according to a first embodiment of the present disclosure.

Hereinafter, embodiments of the present disclosure will be described with reference to the attached drawings. While reference numerals are given to components of each drawing, it should be noted that although shown in different drawings, like components will be referred to as like reference numerals if possible. Also, in a description of the embodiments of the present disclosure, a detailed description of well-known components or functions of the related art will be omitted when it is deemed to obscure understanding of the embodiments of the present disclosure. Also, although the embodiments of the present disclosure will be described below, the technical concept of the present disclosure is not limited or restricted thereto and a variety of modifications thereof may be made by one of ordinary skill in the art. Meanwhile, vertical and lateral directions which will be described below are on the basis of the drawings for convenience, and the scope of the present disclosure is not limited to the corresponding directions.

Throughout the specification, when a part is stated as being "connected" to another part, the part is not only "directly connected" but also "indirectly connected" to the other component with another device therebetween. Throughout the specification, when a portion is stated as "including" a component, unless defined particularly otherwise, it means that the portion may not exclude another component but may further include another component.

Also, in describing components of the embodiments of the present disclosure, the terms such as first, second, A, B, (a), (b), and the like may be used. These terms are merely for distinguishing one element from another, and the essential, order, sequence, and the like of corresponding elements are not limited by the terms.

Also, in the specification, the term upward movement or downward movement includes not only absolute movement but also relative movement in comparison to another component.

Figure 2:
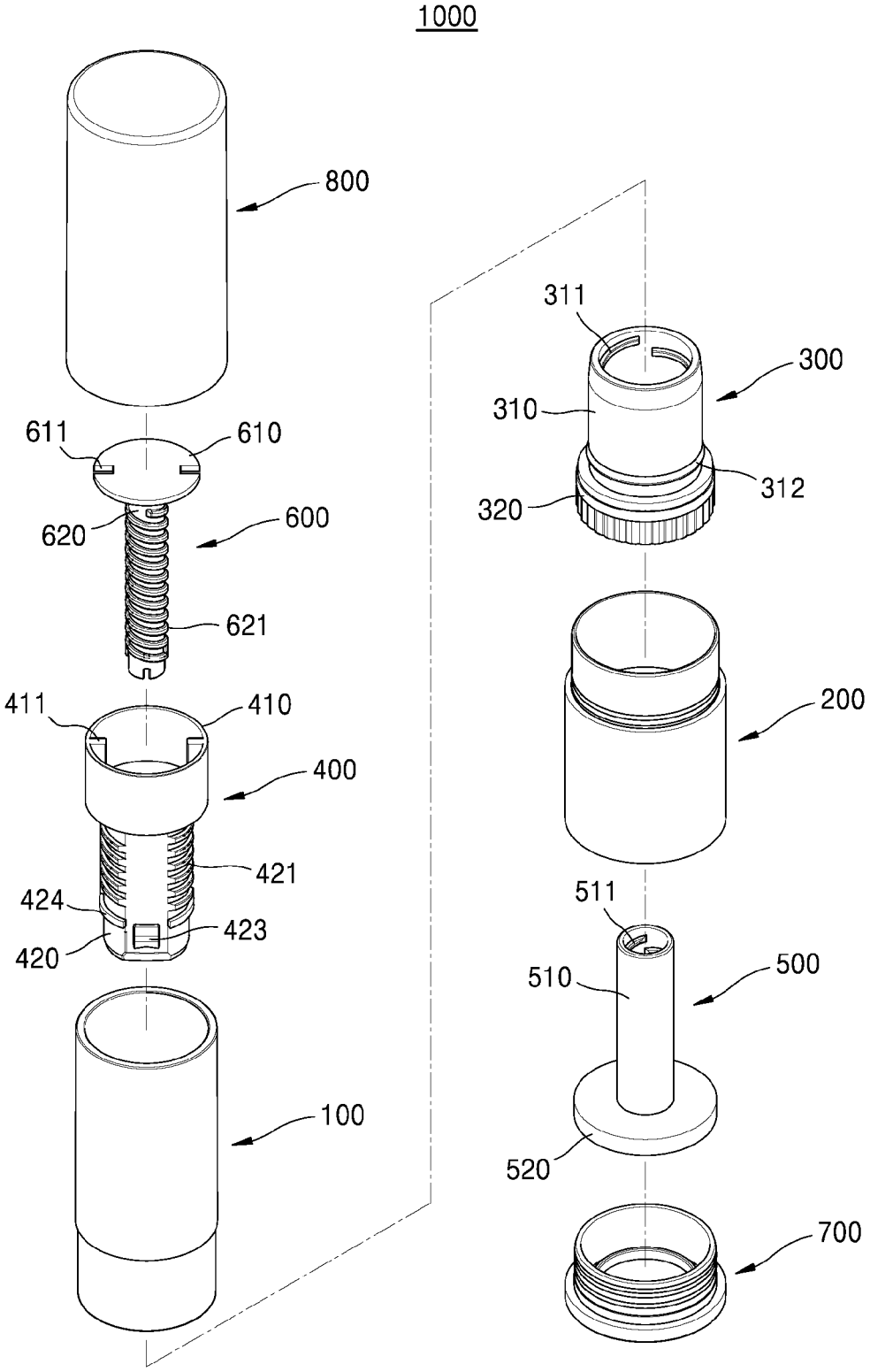
Figure 3A:
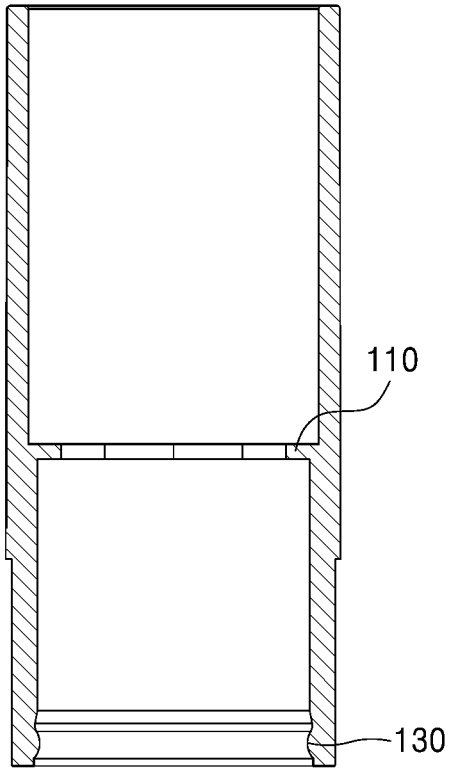
FIGS. 3A and 3B illustrate a housing of the container for stick type content according to the first embodiment of the present disclosure.
Figure 3B:
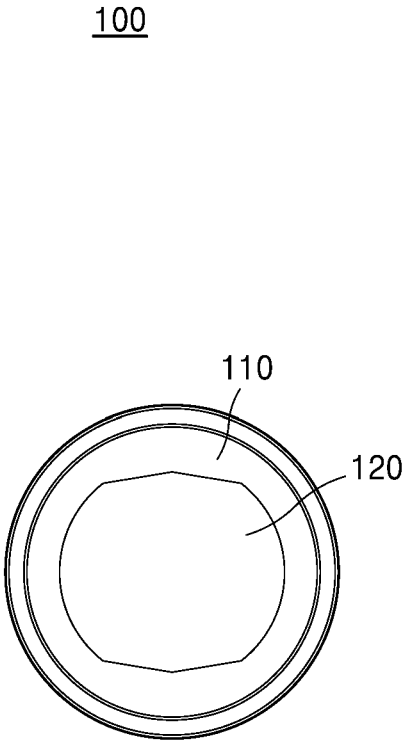
Figure 4A:
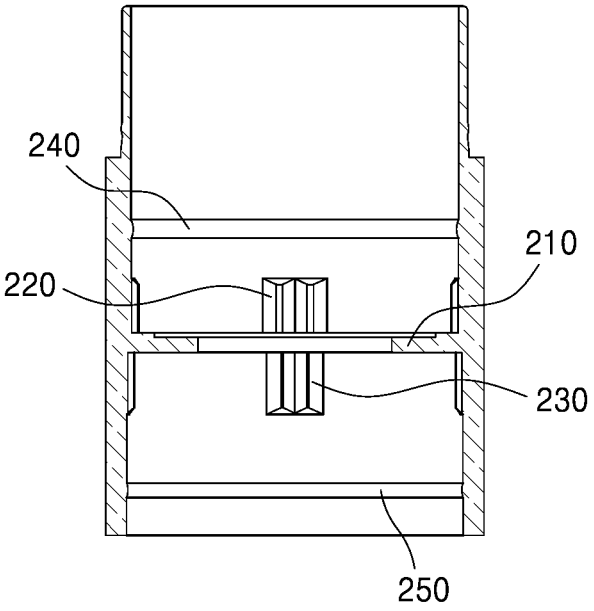
FIGS. 4A and 4B illustrate a rotation portion of the container for stick type content according to the first embodiment of the present disclosure.
Figure 4B:
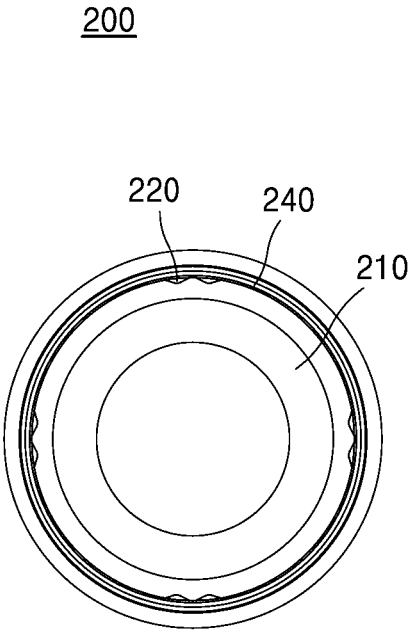
Figure 5A:
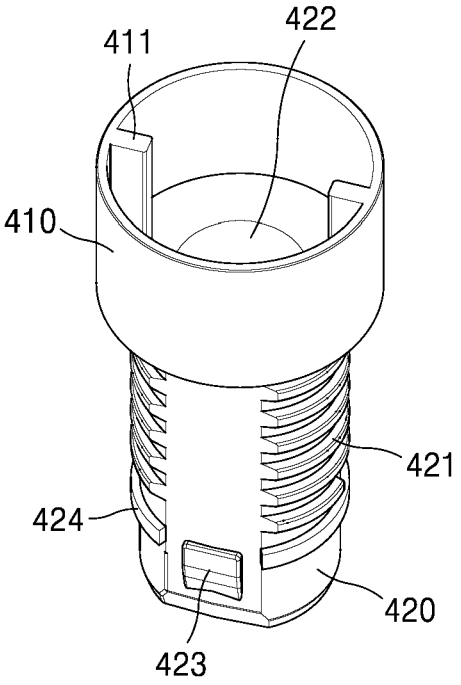
FIGS. 5A and 5B illustrate a first lifting portion of the container for stick type content according to the first embodiment of the present disclosure.
Figure 5B:
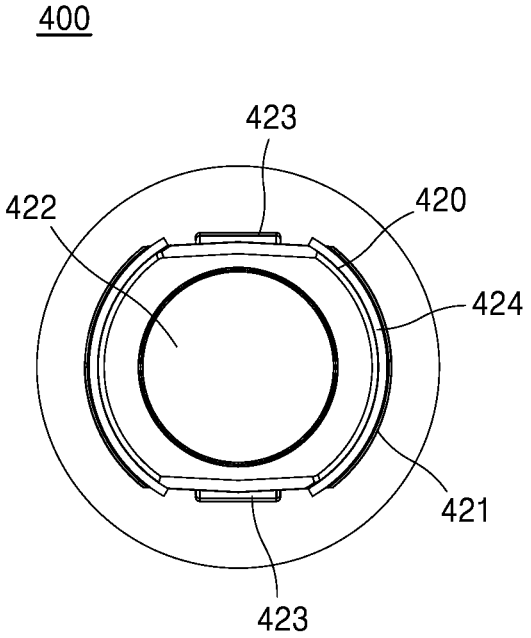
Figure 6:
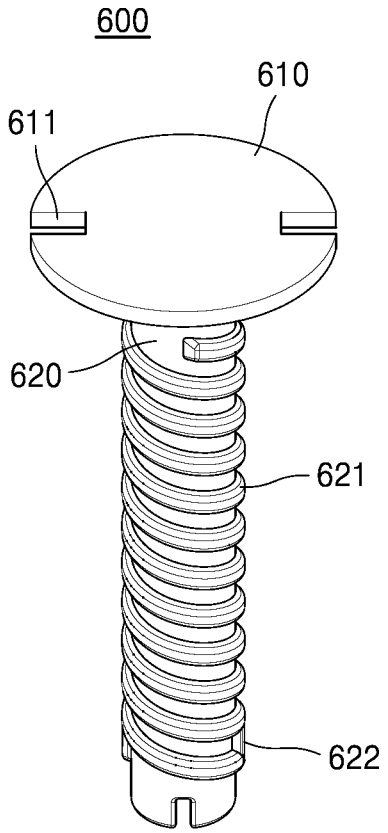
FIG. 6 illustrates a second lifting portion of the container for stick type content according to the first embodiment of the present disclosure.

FIGS. 1 and 2 illustrate a container for stick type content according to a first embodiment of the present disclosure, FIGS. 3A and 3B illustrate a housing of the container for stick type content according to the first embodiment of the present disclosure, FIGS. 4A and 4B illustrate a rotation portion of the container for stick type content according to the first embodiment of the present disclosure, FIGS. 5A and 5B illustrate a first lifting portion of the container for stick type content according to the first embodiment of the present disclosure, and FIG. 6 illustrates a second lifting portion of the container for stick type content according to the first embodiment of the present disclosure.

Referring to FIGS. 1 to 6, a container 1000 for stick type content may include a housing 100, manipulation portions 200, 300, and 500, a first lifting portion 400, a second lifting portion 600, a lower cap 700, and an upper cap 800.

The housing 100 may accommodate content and/or other components such as the first lifting portion 400, the second lifting portion 600, and the like therein. Also, the housing 100 has an open upper cross-section so that an outlet (not shown) configured to expose the content outward may be formed on top. Here, the content may be solid or semisolid cosmetics, medications, or sanitary aid, or the like but is not limited thereto. In one embodiment, the content may be a stick-type sunscreen, a stick-type foundation, a lipstick, a lip balm, or the like.

The housing 100 may include a first edge portion 110 protruding inward from an inner surface and a through hole 120 formed inside the first edge portion 110. An accommodation portion 410 of the first lifting portion 400 may be disposed above the first edge portion 110, and a first load portion 420 extending downward from the accommodation portion 410 may pass through the through hole 120 and be disposed below the first edge portion 110. In one embodiment, the through hole 120 may be formed to have, for example, a non-circular shape having a width in one direction different from a width in another direction perpendicular to the one direction.

A first coupling portion 130 configured to be coupled with the manipulation portions 200, 300, and 500 may be formed on an internal lower end of the housing 100. For example, the first coupling portion 130 may be formed of an annular protrusion, groove, or a combination thereof but is not limited thereto.

The manipulation portions 200, 300, and 500 may be coupled to a lower side of the housing 100 to be relatively rotatable with the housing 100 so as to lift the first lifting portion 400 and/or the second lifting portion 600 in the housing 100 according to rotational manipulation of a user. The manipulation portions 200, 300, and 500 may include a rotation portion 200, a first driving portion 300, and a second driving portion 500.

The rotation portion 200 may be coupled to the housing 100 to surround at least a part of the lower side and may relatively rotate with respect to the housing 100 in a first direction or a second direction opposite thereto according to manipulation of the user. According to rotation of the rotation portion 200, the first driving portion 300 and the second driving portion 500 may rotate synchronously (or integrally) with the rotation portion 200.

The rotation portion 200 may include a second edge portion 210 protruding inward from an inner surface and a through hole 120 formed inside the second edge portion 210. Also, on an inner surface of the rotation portion 200, one or more second coupling protrusions 220 may be formed above the second edge portion 210, and a pressurizing protrusion 230 pressed against an outer surface of the second driving portion 500 may be formed below the second edge portion 210. For example, the second coupling protrusions 220 and the pressurizing protrusion 230 may be formed to have certain lengths in a vertical direction. The second coupling protrusions 220 and the pressurizing protrusion 230 may perform functions of coupling the first driving portion 300 and the second driving portion 500 to the rotation portion 200 to be synchronously rotatable therewith as described above.

In one embodiment, a third coupling protrusion 240 configured to assist coupling with the first driving portion 300 may be further formed on the inner surface of the rotation portion 200. For example, the third coupling protrusion 240 may be formed above the second edge portion 210 and may be implemented to be fastened to a coupling groove (not shown) formed in the first driving portion 300.

The first driving portion 300 may be coupled to an inside of the rotation portion 200 to be synchronously rotatable therewith and may lift the first lifting portion 400. The first driving portion 300 may include a first lift pipe 310 and a first base portion 320.

The first lift pipe 310 may have a cylindrical shape with perforated upper and lower surfaces and may be disposed to surround at least a part (particularly, the first load portion 420) of the first lifting portion 400 from outside. One or more first lift protrusions 311 may be formed on an inner surface of the first lift pipe 310. The first lift protrusions 311 move along a first guide protrusion 421 of the first lifting portion 400 due to rotation of the manipulation portions 200, 300, and 500 or the rotation portion 200 so as to move the first lifting portion 400 upward or downward.

A second coupling portion 312 fastened to the first coupling portion 130 of the housing 100 and configured to couple the manipulation portions 200, 300, and 500 to the housing 100 to be relatively rotatable therewith may be formed on the outer surface of the first lift pipe 310. For example, the second coupling portion 312 may be formed of an annular protrusion, groove, or a combination thereof, like the first coupling portion 130, but is not limited thereto.

The first base portion 320 may be formed on a lower end of the first lift pipe 310 and disposed above the second edge portion 210 of the rotation portion 200. The first base portion 320 may be formed to protrude outward further than the first lift pipe 310 and may include one or more first coupling protrusions 321 formed along an outer surface. For example, a plurality of such first coupling protrusions 321 may be provided and formed to have a certain length in a vertical direction. The second coupling protrusions 220 of the rotation portion 200 are inserted between and engaged with the first coupling protrusions 321 so that the first driving portion 300 may be coupled to the rotation portion 200 to be synchronously rotatable.

The second driving portion 500 may be coupled to the inside of the rotation portion 200 to be synchronously rotatable therewith and may lift the second lifting portion 600. The second driving portion 500 may include a second lift pipe 510 and a second base portion 520.

The second lift pipe 510 may have a cylindrical shape with perforated upper and lower surfaces and may be disposed between the first lifting portion 400 and the second lifting portion 600 to surround at least a part (particularly, a second load portion 620) of the second lifting portion 600 from outside. One or more second lift protrusions 511 may be formed on an inner surface of the second lift pipe 510. The second lift protrusions 511 move along a second guide protrusion 621 of the second lifting portion 600 due to rotation of the manipulation portions 200, 300, and 500 or the rotation portion 200 so as to move the second lifting portion 600 upward or downward.

The second base portion 520 may be formed to protrude outward from a lower end of the second lift pipe 510 and may be disposed below the second edge portion 210 of the rotation portion 200. The pressurizing protrusion 230 of the rotation portion 200 may be pressed against an outer surface of the second base portion 520 and may pressurize the second base portion 520 so that the second driving portion 500 may be coupled to the rotation portion 200 to be synchronously rotatable.

The first lifting portion 400 may accommodate at least part of the content inside the housing 100 and may be lifted according to rotation of the manipulation portions 200, 300, and 500 so that the content may be exposed outside or accommodated inside the housing 100. The first lifting portion 400 may include the accommodation portion 410 and the first load portion 420.

The accommodation portion 410 may accommodate at least a part of the content therein. For example, it may be configured that a lower end of the content is inserted into the accommodation portion 410 and a residual part of an upper side is accommodated in the housing 100. The accommodation portion 410 may include one or more fixing protrusions 411 protruding inward from an inner surface and extending by a certain length in a vertical direction. Each of the fixing protrusions 411 is inserted into a corresponding incised groove 611 of the second lifting portion 600 so that the first lifting portion 400 and the second lifting portion 600 may be coupled to each other to be synchronously rotatable.

The first load portion 420 may be formed to extend downward from a lower end of the accommodation portion 410 and may be at least partially accommodated inside the first lift pipe 310 of the first driving portion 300. Also, the first load portion 420 passes through in an up-down direction so that a hollow 422 communicating with the accommodation portion 410 may be formed therein. Through the hollow 422, the second lift pipe 510 of the second driving portion 500 and the second load portion 620 of the second lifting portion 600 may be accommodated in the first load portion 420.

The first guide protrusion 421 may be formed on an outer surface of the first load portion 420. In one embodiment, the first guide protrusion 421 may be formed by arranging a plurality of protrusions having a certain tilt angle, thickness, and length to be spaced apart in a range from a point of a lower side of the first load portion 420 to a point of an upper side of the first load portion 420. Also, in one embodiment, the first guide protrusion 421 may be continuously formed along the outer surface of the first load portion 420 from a point of the lower side to a point of the upper side of the first load portion 420 to form a spiral shape. The first lift protrusions 311 formed on the first lift pipe 310 move along the first guide protrusion 421 due to rotation of the manipulation portions 200, 300, and 500 or the rotation portion 200 so that the first lifting portion 400 may move upward or downward in the housing 100.

In one embodiment, the first load portion 420 may have a horizontal cross section of a non-circular shape corresponding to the through hole 120 of the housing 100. The first load portion 420 is inserted into the through hole 120 of the housing 100 so that the first lifting portion 400 may be coupled integrally with the housing 100 to be synchronously rotatable. That is, due to the non-circular shapes of the first load portion 420 and the through hole 120, even when the manipulation portions 200, 300, and 500 rotate, the first lifting portion 400 may not rotate with the manipulation portions 200, 300, and 500 and may move upward or downward in the housing 100.

One or more restriction protrusions 423 and 424 configured to restrict an upward movement height of the first lifting portion 400 may be formed on the lower side of the first load portion 420 to protrude from an outer surface thereof. For example, the restriction protrusions 423 and 424 may be formed at positions spaced downward at certain distances apart from a lower end of the first guide protrusion 421 and may include a first restriction protrusion 423 protruding outward from a point on the outer surface and/or a second restriction protrusion 424 formed to extend by a certain length toward an outer circumferential surface. When the first lifting portion 400 moves upward to a certain height, the restriction protrusions 423 and 424 come into contact with the first lift protrusion 311 separated from the first guide protrusions 421 so as to restrict the upward movement height of the first lifting portion 400 and to prevent separation of the first lifting portion 400 simultaneously.

The second lifting portion 600 supports the content from below and is lifted according to rotation of the manipulation portions 200, 300, and 500 to move further upward than the first lifting portion 400 so that all the residue of the content may be exposed outside the housing 100. The second lifting portion 600 may include a support portion 610 and the second load portion 620.

The support portion 610 may be formed to have a plate shape having a certain thickness and disposed inside the accommodation portion 410 so as to support the content from below. For example, a lower surface of the support portion 610 may be pressed against a bottom of the accommodation portion 410 and the content may be disposed on an upper surface of the support portion 610. One or more incised grooves 611 may be formed on a periphery of the support portion 610. The incised groove 611 is formed corresponding to the fixing protrusion 411 of the accommodation portion 410, and the fixing protrusion 411 is inserted into the incised groove 611 so that the second lifting portion 600 may be coupled to the first lifting portion 400 to be synchronously rotatable. Accordingly, even when the manipulation portions 200, 300, and 500 rotate, the second lifting portion 600 may not rotate with the manipulation portions 200, 300, and 500 and may move upward or downward in the housing 100.

The second load portion 620 may be formed to extend downward from a lower surface of the support portion 610 and may be at least partially accommodated inside the second lift pipe 510 of the second driving portion 500. The second guide protrusion 621 may be formed on an outer surface of the second load portion 620. For example, the second guide protrusion 621 may be continuously formed along the outer surface of the second load portion 620 from a point of the lower side to a point of the upper side of the second load portion 620 to form a spiral shape. The second lift protrusions 511 formed on the second lift pipe 510 move along the second guide protrusion 621 due to rotation of the manipulation portions 200, 300, and 500 or the rotation portion 200 so that the second lifting portion 600 may move upward or downward.

In one embodiment, a vertical distance between an upper end and a lower end of the second guide protrusion 621 formed on the second load portion 620 may be formed to be greater than a vertical distance between an upper end and a lower end of the first guide protrusion 421 formed on the first load portion 420. Accordingly, the second lifting portion 600 may move further upward while upward movement of the first lifting portion 400 is restricted.

In one embodiment, a separation prevention protrusion 622 may be formed on the lower end of the second guide protrusion 621. For example, the separation prevention protrusion 622 may be formed to be continuous with the lower end of the second guide protrusion 621 and to be bent upward from the lower end of the second guide protrusion 621. The second lift protrusions 511 may be held by the separation prevention protrusion 622 so as to prevent the second lifting portion 600 from being randomly separated upward.

The lower cap 700 may be coupled to an open lower end of the rotation portion 200 and may seal the lower end of the rotation portion 200. For example, the lower cap 700 may be inserted and coupled through the lower end of the rotation portion 200. Although a coupling protrusion and/or a coupling groove may be formed on an inner surface of the rotation portion 200 and/or an outer circumferential surface of the lower cap 700 for coupling with the lower cap 700, this is an example, and a variety of components for coupling may be applied.

The upper cap 800 may be coupled to cover an outlet of the housing 100 and may protect the content accommodated in the housing 100 from contamination. The upper cap 800 may be detachably coupled to an outer surface of the housing 100 and/or the rotation portion 200 and may be separated therefrom by the user. Although a step, a holding step, a holding protrusion, or the like may be provided on an inner surface of the upper cap 800 and the outer surface of the housing 100 and/or the rotation portion 200 to improve a coupling force of the upper cap 800, this is merely an example and a variety of structures used for detachment of the upper cap 800 may be applied in addition thereto.

FIGS. 7A to 8B illustrate an example of using the container for stick type content according to the first embodiment of the present disclosure.

Figure 7A:
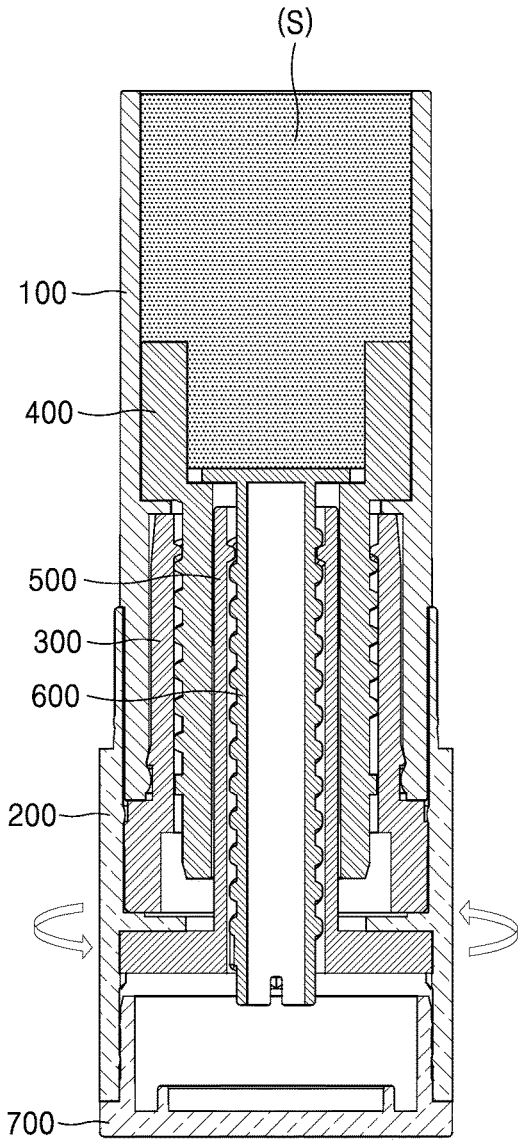
FIGS. 7A to 8B illustrate an example of using the container for stick type content according to the first embodiment of the present disclosure.
Figure 7B:
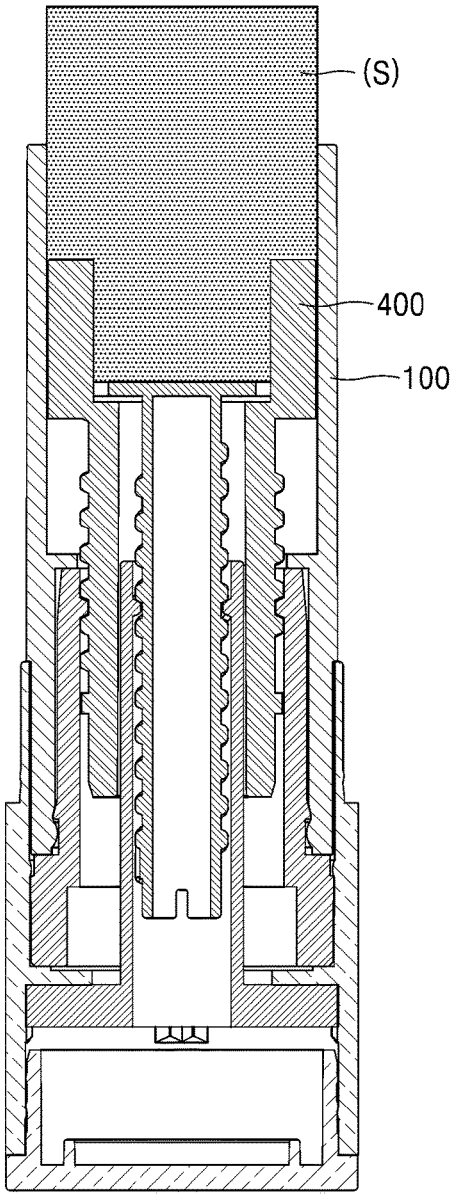

First, referring to FIGS. 7A and 7B, the user may move the first lifting portion 400 and the second lifting portion 600 upward simultaneously so as to expose content S outside the housing 100.

For example, when the user rotates the rotation portion 200 in the first direction while gripping the housing 100, the first driving portion 300 and the second driving portion 500 which are coupled thereto also rotate in the first direction, and the first lift protrusions 311 and the second lift protrusions 511 may move along the first guide protrusion 421 and the second guide protrusion 621, respectively. Accordingly, since the first lifting portion 400 and the second lifting portion 600 move upward simultaneously, the content S may be moved upward to be exposed outward through the outlet of the housing 100. Here, to allow lift speeds of the first lifting portion 400 and the second lifting portion 600 to be equal, the first guide protrusion 421 and the second guide protrusion 621 may be formed to have gradations, intervals, and the like corresponding to each other.

Meanwhile, when the user finishes using the content S and rotates the rotation portion 200 in the second direction, the first driving portion 300 and the second driving portion 500 move downward simultaneously so that the content S may be accommodated in the housing 100.

Subsequently, referring to FIGS. 8A and 8B, when a residual amount of the content S is small, the user may rotate the rotation portion 200 further in the first direction and move the second lifting portion 600 upward alone so as to expose the content S outside the housing 100.

For example, when the first lifting portion 400 moves upward to a certain height due to rotation of the rotation portion 200 in the first direction, the first lift protrusions 311 may be separated from the first guide protrusion 421 and located between the lower end of the first guide protrusion 421 and the restriction protrusions 423 and 424 spaced apart therefrom. Accordingly, even when the rotation portion 200 keeps rotating in the first direction, the first lift protrusions 311 rotate only in place between the lower end of the first guide protrusion 421 and the restriction protrusions 423 and 424 and thus the first lifting portion 400 can not move further upward. On the other hand, since the second lift protrusions 511 may move further along the second guide protrusion 621 left on the lower side, only the second lifting portion 600 may keep moving upward alone. Accordingly, since the support portion 610 of the second lifting portion 600 lifts up the content S from inside the accommodation portion 410, the residue of the content S is exposed outside the housing 100.

Meanwhile, when the user finishes using the content S and rotates the rotation portion 200 in the second direction, the second lifting portion 600 moves downward alone, and thus the content S may be accommodated inside the housing 100 and/or the accommodation portion 410. Also, when necessary, the user may keep rotating the rotation portion 200 in the second direction. Accordingly, when the support portion 610 reaches a bottom surface of the accommodation portion 410, the first lifting portion 400 and the second lifting portion 600 may be moved downward simultaneously.

Figure 9:
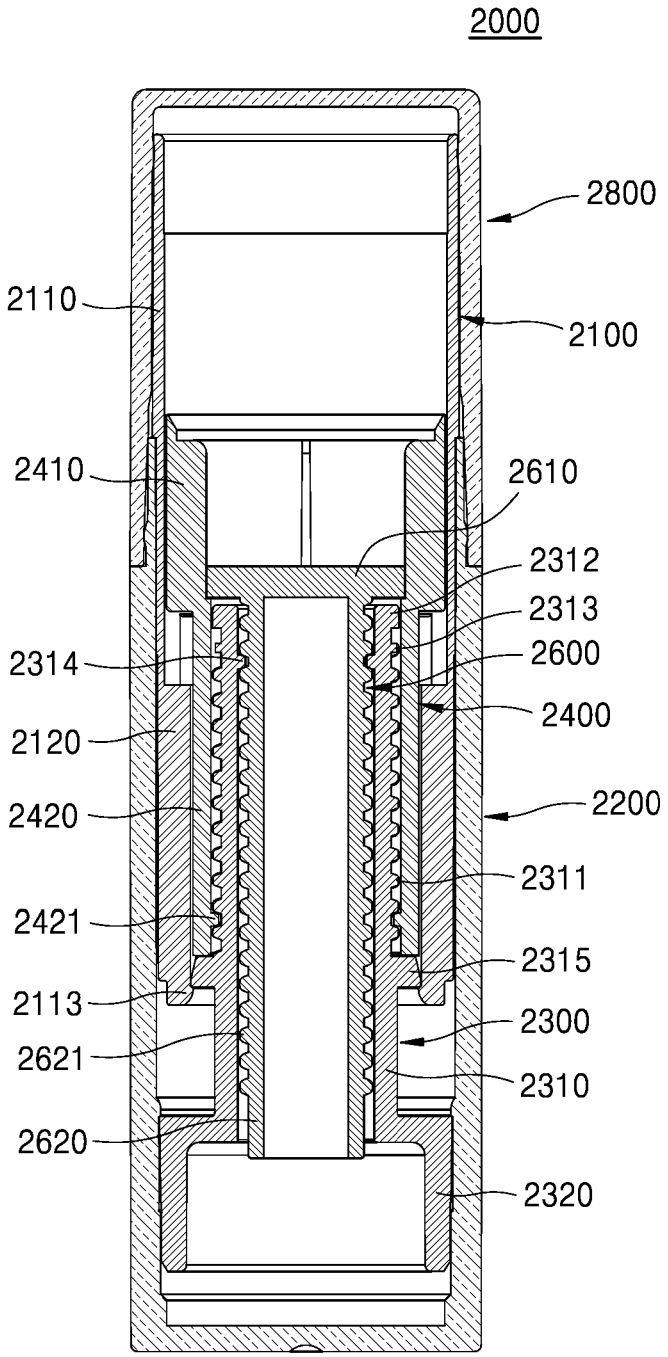
FIGS. 9 and 10 illustrate a container for stick type content according to a second embodiment of the present disclosure.
Figure 10:
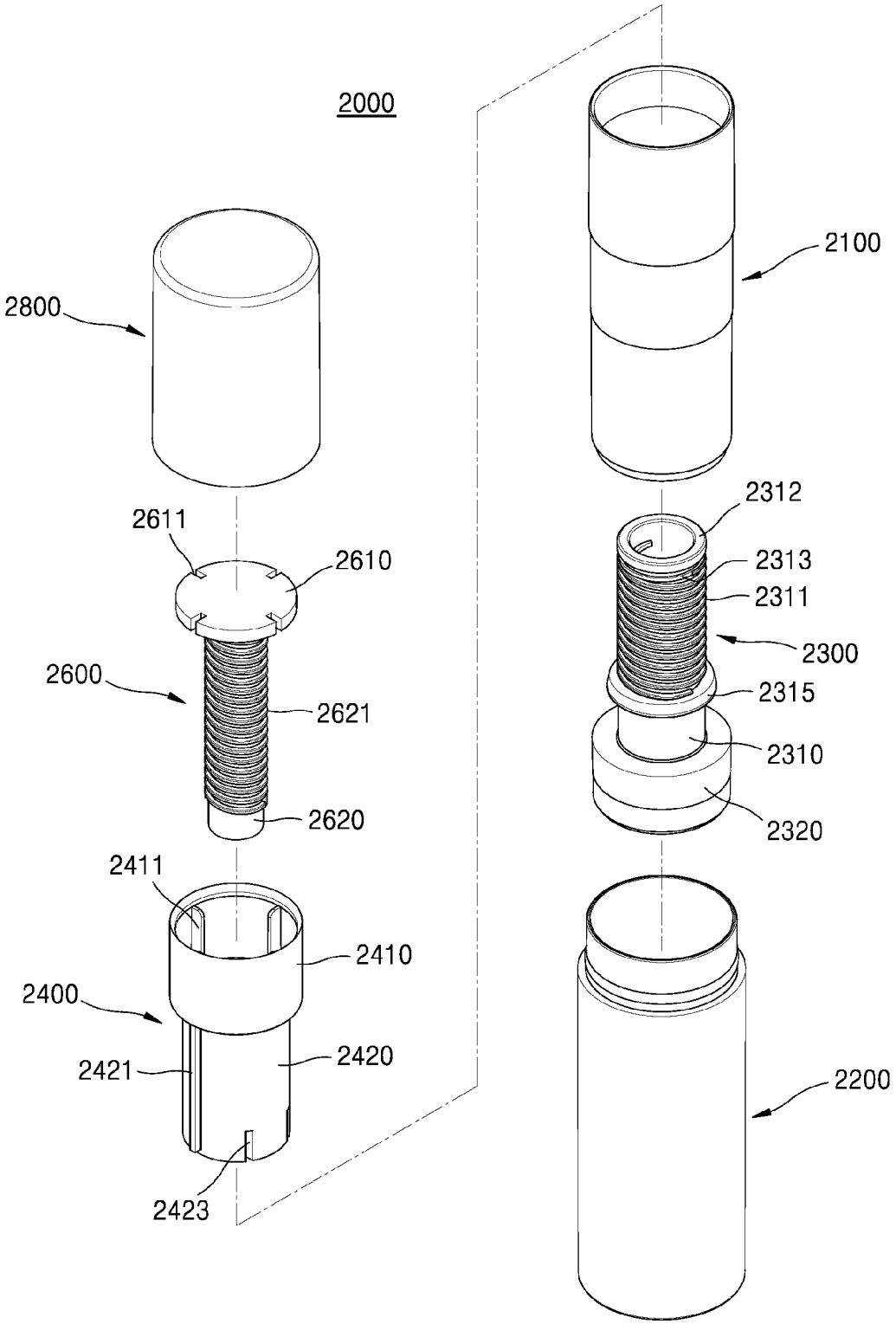
Figure 11A:
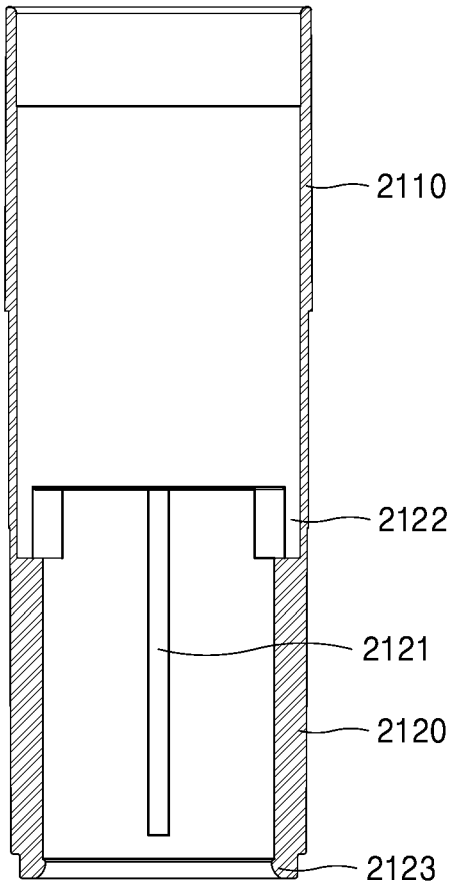
FIGS. 11A and 11B illustrate a housing of the container for stick type content according to the second embodiment of the present disclosure.
Figure 11B:
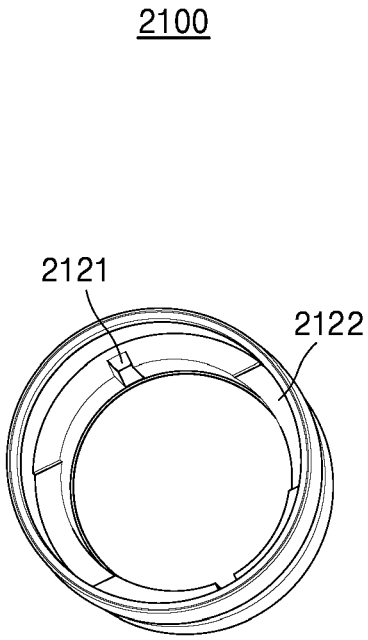
Figure 12A:
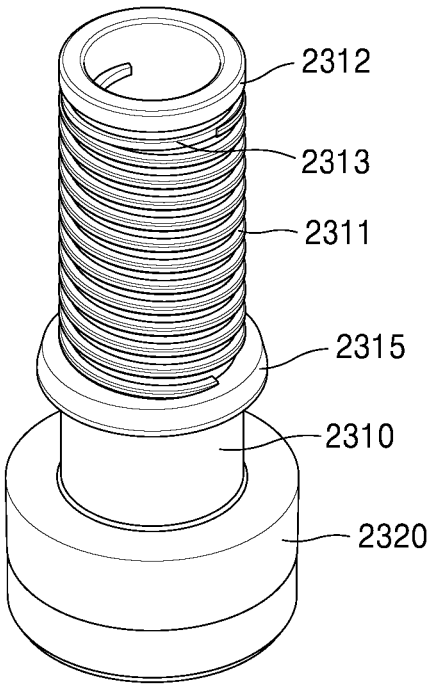
FIGS. 12A and 12B illustrate a driving portion of the container for stick type content according to the second embodiment of the present disclosure.
Figure 12B:
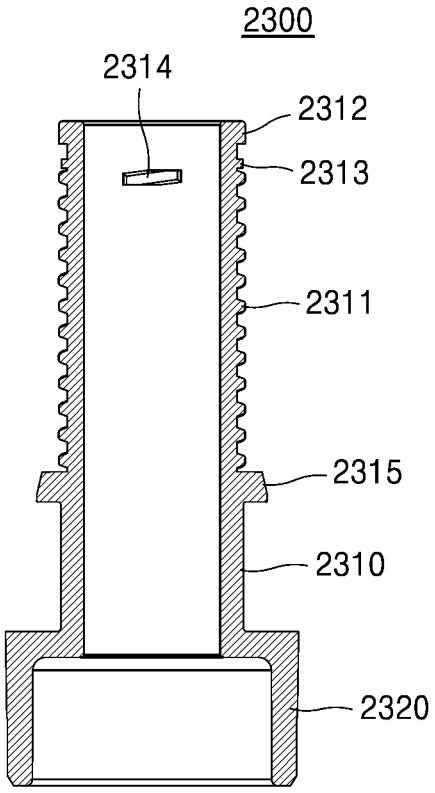
Figure 13A:
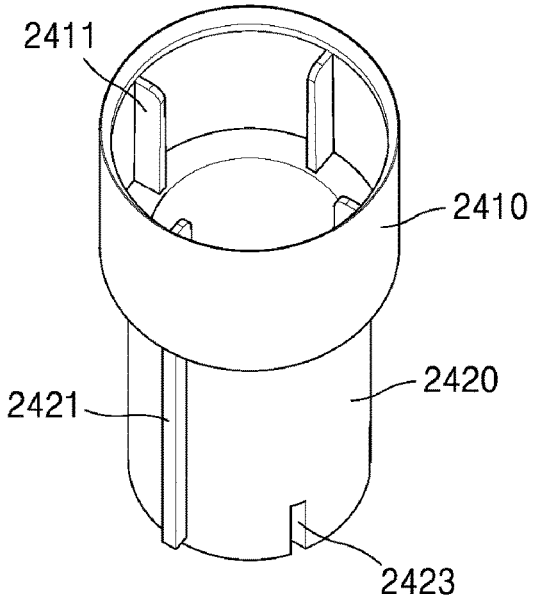
FIGS. 13A and 13B illustrate a first lifting portion of the container for stick type content according to the second embodiment of the present disclosure.
Figure 13B:
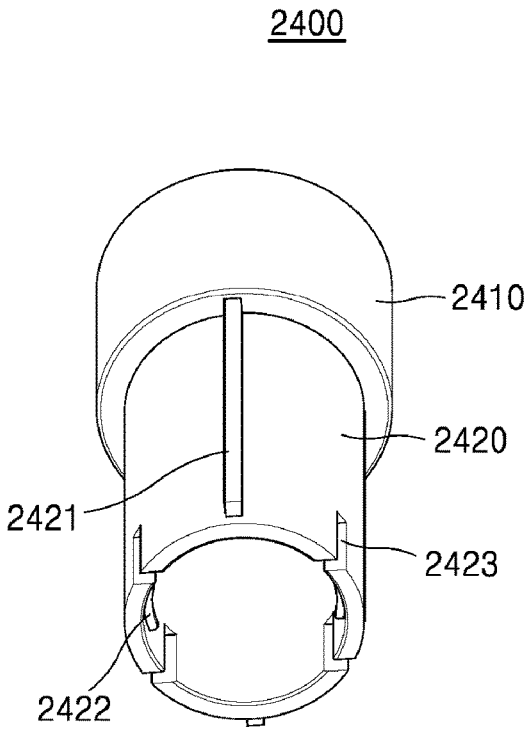

FIGS. 9 and 10 illustrate a container for stick type content according to a second embodiment of the present disclosure, FIGS. 11A and 11B illustrate a housing of the container for stick type content according to the second embodiment of the present disclosure, FIGS. 12A and 12B illustrate a driving portion of the container for stick type content according to the second embodiment of the present disclosure, and FIGS. 13A and 13B illustrate a first lifting portion of the container for stick type content according to the second embodiment of the present disclosure.

Referring to FIGS. 9 to 13, a container 2000 for stick type content may include a housing 2100, manipulation portions 2200 and 2300, a first lifting portion 2400, a second lifting portion 2600, and an upper cap 2800.

The housing 2100 may accommodate content and/or other components therein. Also, the housing 2100 has an open upper cross-section so that an outlet (not shown) configured to expose the content outward may be formed on top. Here, the content may be solid or semisolid cosmetics, medications, sanitary aid, or the like but is not limited thereto.

The housing 2100 may include an upper housing 2110 in which the content is accommodated and a lower housing 2120 formed below the upper housing 2110. For example, the lower housing 2120 may be formed to be continuous with a lower side of the upper housing 2110 and may have an inner diameter smaller than the upper housing 2110.

One or more fixing grooves 2121 may be formed to be recessed in an inner surface of the lower housing 2120. For example, the fixing grooves 2121 may be formed to have a certain length in a vertical direction (or an up-down direction), and one or more fixing grooves 2121 may be arranged to be spaced apart along an inner circumferential surface of the lower housing 2120. Since second fixing protrusions 2421 of the first lifting portion 2400 which are formed to correspond to the fixing grooves 2121 are inserted into the fixing grooves 2121, the housing 2100 and the first lifting portion 2400 may be coupled to be synchronously (or integrally) rotatable.

One or more open grooves 2112 may be formed to be recessed in the inner surface of the lower housing 2120. The open grooves 2112 may provide a space for external deformation of a lower end of a first load portion 2420. For example, since the first lifting portion 2400 moves upward due to rotation of the manipulation portions 200 and 300, a lower end of the first load portion 2420, on which a first lift protrusion 2422 is formed, is located to correspond to the open grooves 2112 formed on an internal upper end of the lower housing 2120. The lower end of the first load portion 2420 may be deformed inside the open grooves 2112 so that the first lift protrusion 2422 may move upward over a second restriction protrusion 2313.

A first rotation coupling protrusion 2123 may protrude inward from an internal lower end of the lower housing 2120 along an inner circumferential surface. The first rotation coupling protrusion 2123 is engaged with a second rotation coupling protrusion 2315 formed on the driving portion 2300 so that the housing 2100 and the driving portion 2300 may be coupled to be relatively rotatable.

The manipulation portions 2200 and 2300 may be coupled to a lower side of the housing 2100 to be relatively rotatable with the housing 2100 so as to lift the first lifting portion 2400 and/or the second lifting portion 2600 in the housing 2100 according to rotational manipulation of a user. The manipulation portions 2200 and 2300 may include a rotation portion 2200 and a driving portion 2300.

The rotation portion 2200 may be coupled to the housing 2100 to surround at least a part of the lower side thereof and may relatively rotate with respect to the housing 2100 in a first direction or a second direction opposite thereto. According to the rotation of the rotation portion 2200, the driving portion 2300 may rotate synchronously with the rotation portion 200. Although one or more coupling protrusions and/or coupling grooves may be formed in an inner surface of the housing 2100 to be coupled with the driving portion 2300, the present disclosure is not limited thereto and may employ a variety of structures to couple the driving portion 2300 to be synchronously rotatable.

The driving portion 2300 is coupled to an inside of the rotation portion 2200 to be synchronously rotatable and may lift the first lifting portion 2400 and/or the second lifting portion 2600 through relative rotation with the housing 2100. In one embodiment, the driving portion 2300 may include a lift pipe 2310 and a base portion 2320.

The lift pipe 2310 may have a cylindrical shape with perforated upper and lower surfaces and with a hollow formed therein and may be disposed between the first lifting portion 2400 and the second lifting portion 2600. For example, the lift pipe 2310 may be at least partially disposed inside the first load portion 2420 of the first lifting portion 2400 while being configured to surround at least a part of a second load portion 2620 of the second lifting portion 2600 from outside.

A first guide protrusion 2311 configured to lift the first lifting portion 2400 may be formed on an outer surface of the lift pipe 2310. For example, the first guide protrusion 2311 may be continuously formed along the outer surface of the lift pipe 2310 from a point of the lower side to a point of the upper side of the lift pipe 2310 to form a spiral shape. When the rotation portion 2200 rotates, the first lift protrusion 2422 formed on an internal lower end of the first lifting portion 2400 moves along the first guide protrusion 2311 so as to move the first lifting portion 2400 upward or downward.

A first restriction protrusion 2312 may be formed on an external upper end of the lift pipe 2310. For example, the first restriction protrusion 2312 is formed on an upper end of the lift pipe 2310 to protrude outward along an outer circumferential surface so as to form an annular shape while being spaced upward at a certain distance apart from an upper end of the first guide protrusion 2311. Although the first lift protrusion 2422 of the first lifting portion 2400 is detached from the first guide protrusion 2311, the first lift protrusion 2422 is restricted by the first restriction protrusion 2312 from moving upward so as to prevent the first lifting portion 2400 from being randomly separated from the driving portion 2300.

In one embodiment, the second restriction protrusion 2313 may be further formed on the external upper end of the lift pipe 2310. For example, the second restriction protrusion 2313 is formed to protrude outward along the outer circumferential surface of the lift pipe 2310 so as to form an annular shape while at least a part thereof is overlapped with the upper end of the first guide protrusion 2311 and spaced below apart from the first restriction protrusion 2312. As described below, when the rotation portion 2200 rotates in the first direction, the first lift protrusion 2422 of the first lifting portion 2400 may cross the second restriction protrusion 2313 and relatively rotate with the driving portion 2300 in a space between the first restriction protrusion 2312 and the second restriction protrusion 2313.

Also, in one embodiment, the second restriction protrusion 2313 may be formed to have a protruding height lower than the first guide protrusion 2311 and the first restriction protrusion 2312. Accordingly, when the rotation portion 200 rotates in the first direction, the first lift protrusion 2422 may move along the first guide protrusion 2311 to the upper end of the first guide protrusion 2311 and then cross the second restriction protrusion 2313 to be located in the space between the first restriction protrusion 2312 and the second restriction protrusion 2313.

One or more second lift protrusions 2314 configured to lift the second lifting portion 2600 may be formed on an inner surface of the lift pipe 2310. For example, the second lift protrusions 2314 may be formed on an internal upper end of the lift pipe 2310 or at positions spaced downward at a certain distance apart from the internal upper end. When the rotation portion 2200 rotates, the second lift protrusions 2314 move along a second guide protrusion 2621 formed on the second lifting portion 2600 so as to move the second lifting portion 2600 upward or downward.

A second rotation coupling protrusion 2315 may be formed on the outer surface of the lift pipe 2310 to protrude outward. For example, the second rotation coupling protrusion 2315 may be formed to form an annular shape along an outer circumferential surface of the lift pipe 2310 and may be disposed below the first guide protrusion 2311. The second rotation coupling protrusion 2315 may support the first lifting portion 2400 from below and may be engaged with the first rotation coupling protrusion 2123 of the housing 2100 so as to couple the driving portion 2300 to the housing 2100 to be relatively rotatable.

The base portion 2320 may be formed to be continuous with a lower end of the lift pipe 2310 while protruding further outward than the lift pipe 2310 and inserted into and coupled to the rotation portion 2220 so as to couple the driving portion 2300 to the rotation portion 2200 to be synchronously rotatable.

The first lifting portion 2400 may accommodate at least part of the content inside the housing 2100 and may be lifted according to rotation of the manipulation portions 2200 and 2300 so that the content may be exposed outside or accommodated inside the housing 2100. The first lifting portion 2400 may include an accommodation portion 2410 and the first load portion 2420.

The accommodation portion 2410 may accommodate at least a part of the content therein. For example, it may be configured that a lower side of the content is inserted into the accommodation portion 2410 and a residual part of an upper side is accommodated in the housing 2100.

The accommodation portion 2410 may include one or more first fixing protrusions 2411 protruding inward from an inner surface and extending by a certain length in a vertical direction. Each of the first fixing protrusions 2411 is inserted into a corresponding incised groove 2611 of the second lifting portion 2600 so that the first lifting portion 2400 and the second lifting portion 2600 may be coupled to each other to be synchronously rotatable.

The first load portion 2420 may be formed to extend downward from a lower end of the accommodation portion 2410 and may have a cylindrical shape with perforated upper and lower surfaces and a hollow formed therein.

One or more second fixing protrusions 2421 corresponding to the fixing grooves 2121 of the housing 2100 may be formed on an outer surface of the first load portion 2420. The second fixing protrusions 2421 may be formed to extend in a vertical direction (that is, an up-down direction) and inserted into the fixing grooves 2121 so as to couple the first lifting portion 2400 to the housing 2100 to be synchronously rotatable. That is, even when the manipulation portions 2200 and 2300 relatively rotate with respect to the housing 2100, the first lifting portion 2400 may not rotate and may move upward or outward in the housing 2100.

At least a part of the lift pipe 2310 may be accommodated in the first load portion 2420, and one or more first lift protrusions 2422 coupled to the first guide protrusion 2311 may be formed on an inner surface of the first load portion 2420. For example, the first lift protrusion 2422 is formed on an internal lower end of the first load portion 2420 and moves along the first guide protrusion 2311 formed on the outer surface of the lift pipe 2310 due to rotation of the manipulation portions 2200 and 2300 so that the first lifting portion 2400 may move upward or downward in the housing 2100.

One or more open portions 2423 may be formed on the lower end of the first load portion 2420. For example, the open portions 2423 may be formed by incising the lower end of the first load portion 2420 upward to a certain position corresponding to the first lift protrusion 2422. In one embodiment, the first lift protrusion 2422 may be disposed between two open portions 2423. When the first lift protrusion 2422 moves along the first guide protrusion 2311 and reaches the second restriction protrusion 2313, the lower end of the first load portion 2420 may be deformed outward by the open portion 2423 so as to cross the second restriction protrusion 2313 and to move to the space between the first restriction protrusion 2312 and the second restriction protrusion 2313.

The second lifting portion 2600 may support the content from below and may be lifted according to rotation of the manipulation portions 2200 and 2300. Particularly, the second lifting portion 2600 alone may move further upward than the first lifting portion 2400 so as to expose all the residue of the content outside the housing 2100. The second lifting portion 2600 may include a support portion 2610 and the second load portion 2620.

The support portion 2610 may be disposed inside the accommodation portion 2410 and may support the content from below. For example, the support portion 2610 may have a plate shape having a certain thickness, a lower surface of the support portion 2610 may be pressed against a bottom of the accommodation portion 2410, and the content may be disposed on an upper surface of the support portion 2610. One or more incised grooves 2611 may be formed on a periphery of the support portion 2610. The incised grooves 2611 may be formed to correspond to the first fixing protrusions 2411 of the accommodation portion 2410, and the first fixing protrusions 2411 may be inserted into the incised grooves 2611. The second lifting portion 2600 may be coupled to the first lifting portion 2400 to be synchronously rotatable through coupling between the first fixing protrusions 2411 and the incised grooves 2611.

The second load portion 2620 may be formed to extend downward from the lower surface of the support portion 2610. The second load portion 2620 may be formed to have, for example, a cylindrical shape and thus may be at least partially accommodated in the lift pipe 2310 of the driving portion 2300. The second guide protrusion 2621 may be formed on an outer surface of the second load portion 2620. For example, the second guide protrusion 2621 may be continuously formed along the outer surface of the second load portion 2620 from a point of the lower side to a point of the upper side of the second load portion 2620 to form a spiral shape. The second lift protrusions 2314 formed on an inner surface of the lift pipe 2310 move along the second guide protrusion 2621 due to rotation of the manipulation portions 2200 and 2300 so that the second lifting portion 2600 may move upward or downward.

In one embodiment, a separation prevention protrusion (not shown) may be formed on a lower end of the second guide protrusion 2621. For example, the separation prevention protrusion may be formed to be continuous with the lower end of the second guide protrusion 2621 while the protrusions may be bent upward from the lower end of the second guide protrusion 2621. The second lift protrusions 2314 may be held by the separation prevention protrusion so as to prevent the second lifting portion 2600 from being randomly separated upward.

Meanwhile, the first lift protrusion 2422 may be formed on the internal lower end of the first load portion 2420, and the second lift protrusion 2314 may be formed on an internal upper end of the lift pipe 2310 or formed to be adjacent to the internal upper end. Accordingly, when the first lifting portion 2400 and the second lifting portion 2600 are moved maximally downward, the second lift protrusion 2314 configured to lift the second lifting portion 2600 may be disposed to be spaced upward at a certain height apart from the first lift protrusion 2422 configured to lift the first lifting portion 2400. Accordingly, although the first load portion 2420, the lift pipe 2310 and/or the first guide protrusion 2311 are not formed to be elongated, the first lifting portion 2400 may move sufficiently upward. When the first lifting portion 2400 is moved maximally upward, the second lift protrusion 2314 may further move some of the second guide protrusions 2621 remaining below so that the second lifting portion 2600 may move further upward alone.

The upper cap 2800 may be coupled to cover an outlet of the housing 2100 and may protect the content accommodated in the housing 2100 from contamination. The upper cap 2800 may be detachably coupled to an outer surface of the housing 2100 and/or the rotation portion 2200 and may be separated therefrom by the user.

FIGS. 14A to 15B illustrate an exemplary operation of the container for stick type content according to the second embodiment of the present disclosure.

Figure 14A:
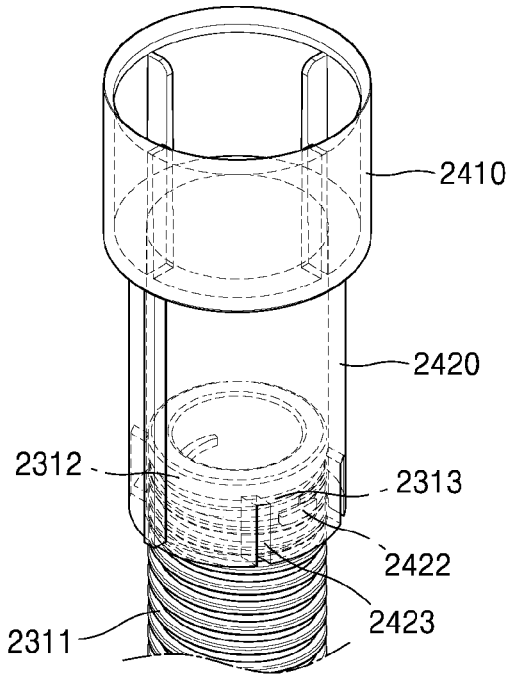
FIGS. 14A to 15B illustrate an exemplary operation of the container for stick type content according to the second embodiment of the present disclosure.
Figure 14B:
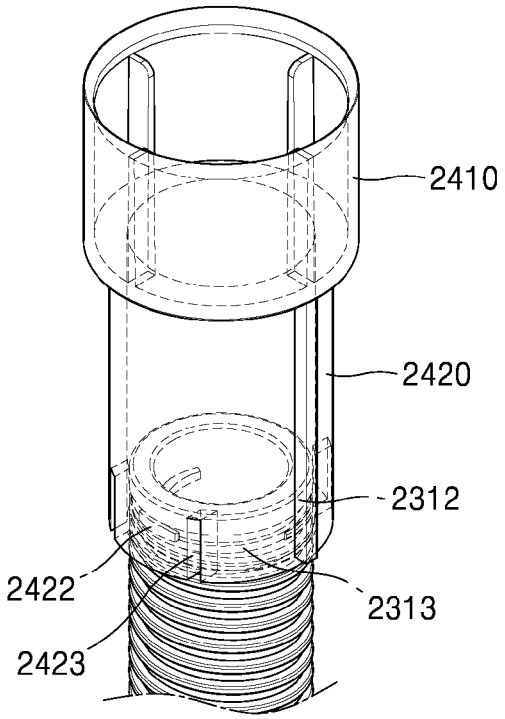
Figure 15A:
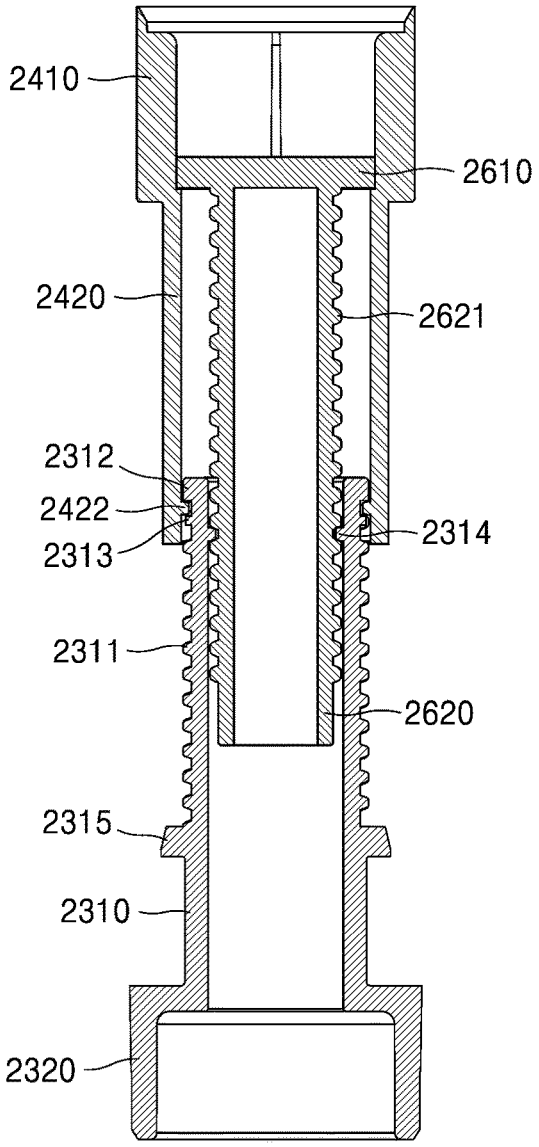
Figure 15B:
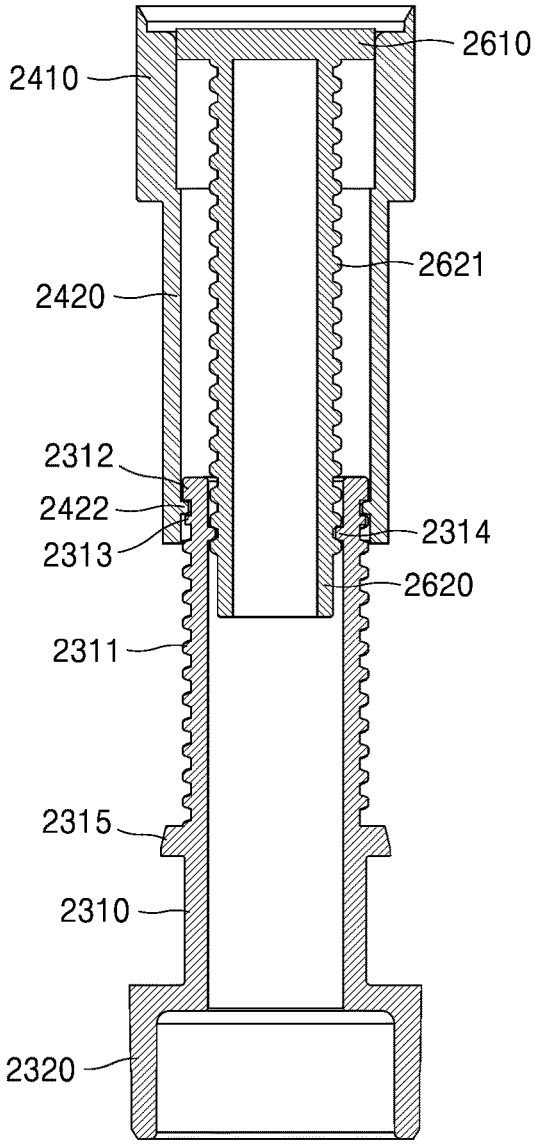

Referring to FIGS. 14A and 14B, when the driving portion 2300 rotates in the first direction due to the rotational manipulation with respect to the rotation portion 2200, the first lift protrusion 2422 of the first lifting portion 2400 moves along the first guide protrusion 2311 of the lift pipe 2310 so that the first lifting portion 2400 may move upward. Subsequently, when the driving portion 2300 rotates in the first direction, the first lift protrusion 2422 reaches the second restriction protrusion 2313 formed to be overlapped with an upper end of the first guide protrusion 2311. Subsequently, the lower end of the first load portion 2420 is deformed outward so that the first lift protrusion 2422 may cross the second restriction protrusion 2313 and move upward to be disposed in the space between the first restriction protrusion 2312 and the second restriction protrusion 2313.

Figure 8A:
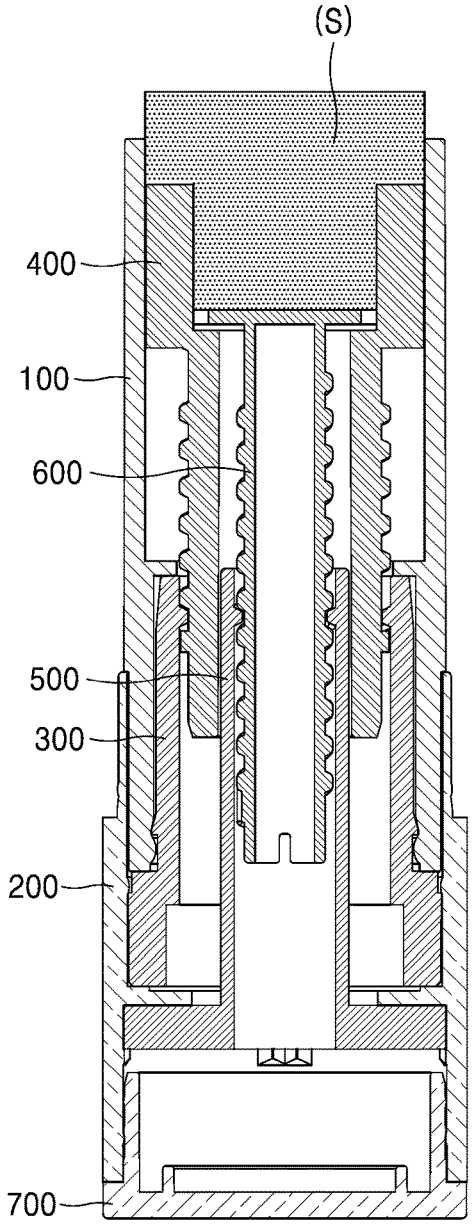
Figure 8B:
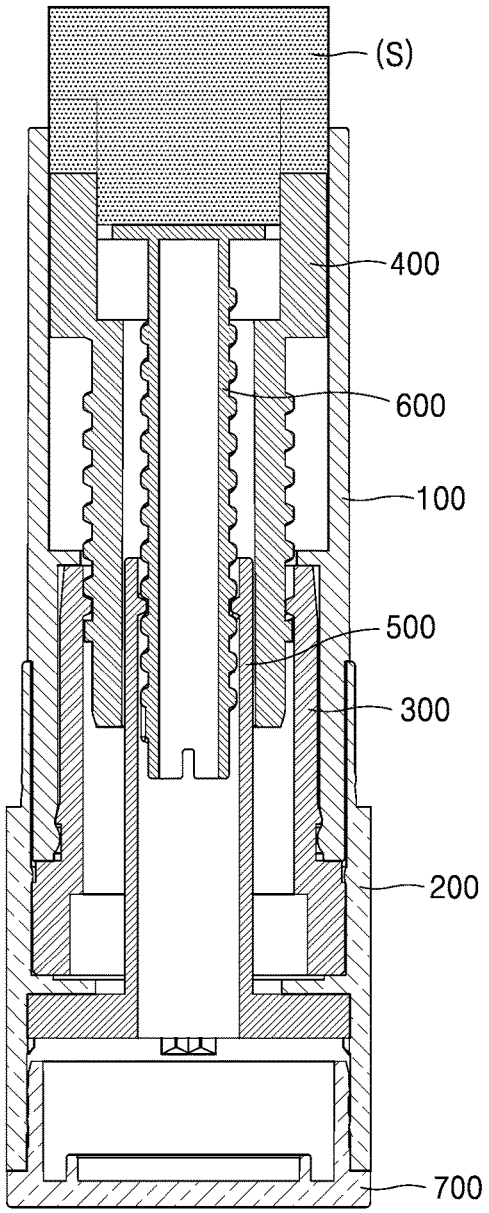

Meanwhile, although not shown in FIGS. 8A and 8B, since the driving portion 2300 rotates in the first direction, the second lift protrusion 2314 of the driving portion 2300 may move along the second guide protrusion 2621 of the second lifting portion 2600 so that the second lifting portion 2600 may move upward with the first lifting portion 2400. Here, to allow lift speeds of the first lifting portion 2400 and the second lifting portion 2600 to be equal, the first guide protrusion 2311 and the second guide protrusion 2621 may be formed to have gradations, intervals, and the like corresponding to each other.

Subsequently, referring to FIG. 9, when the first lift protrusion 2422 crosses the second restriction protrusion 2313 and reaches the space between the first restriction protrusion 2312 and the second restriction protrusion 2313, although the driving portion 2300 rotates further in the first direction, the first lift protrusion 2422 only rotates in place with respect to the driving portion 2300 in the space so that the first lifting portion 2400 may not further move upward.

Meanwhile, since the second lift protrusion 2314 may move further along the second guide protrusions 2621 left below, the second lifting portion 2600 may move upward continuously alone so that the support portion 2610 moves upward from inside the accommodation portion 2410.

Meanwhile, when the driving portion 2300 rotates in the second direction while only the second lifting portion 2600 has moved further upward, the second lifting portion 2600 moves downward so that the support portion 2610 reaches a bottom surface of the accommodation portion 2410. Due to a pressure of the support portion 2610, the first lift protrusion 2422 may cross the second restriction protrusion 2313 in a downward direction. Accordingly, the first lifting portion 2400 and the second lifting portion 2600 may move downward together according to the rotation of the driving portion 2300 in the second direction.

Meanwhile, when the driving portion 2300 rotates in the second direction while only the second lifting portion 2600 moves further upward alone, the second lift protrusion 2314 moves along the second guide protrusion 2621 and thus the second lifting portion 2600 may move downward first. Here, since the second lift protrusion 2314 rotates in place in the space between the first restriction protrusion 2312 and the second restriction protrusion 2313, the first lifting portion 2400 may remain in an original position instead of moving downward. Subsequently, when the support portion 2610 reaches the bottom surface of the accommodation portion 2410 due to downward movement of the second lifting portion 2600, the first lift protrusion 2422 crosses the second restriction protrusion 2313 and moves downward due to the pressure of the support portion 2610, and thus the first lift protrusion 2422 moves along the first guide protrusion 2311 so that the first lifting portion 2400 and the second lifting portion 2600 may move downward together.

Figure 16A:
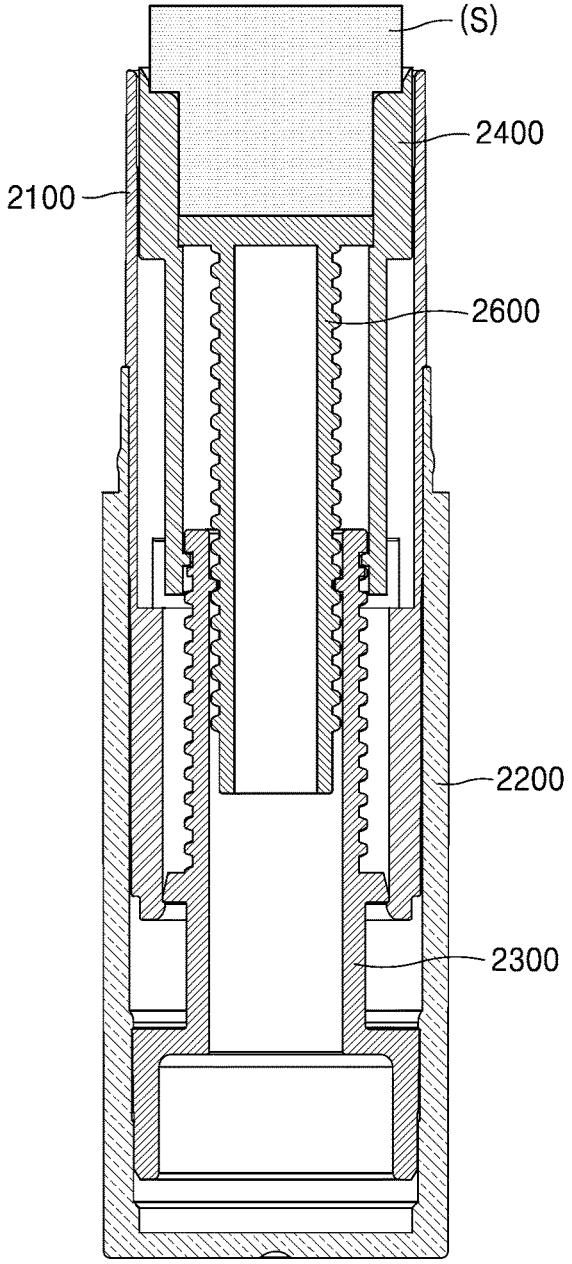
FIGS. 16A and 16B illustrate an example of using the container for stick type content according to the second embodiment of the present disclosure.
Figure 16B:
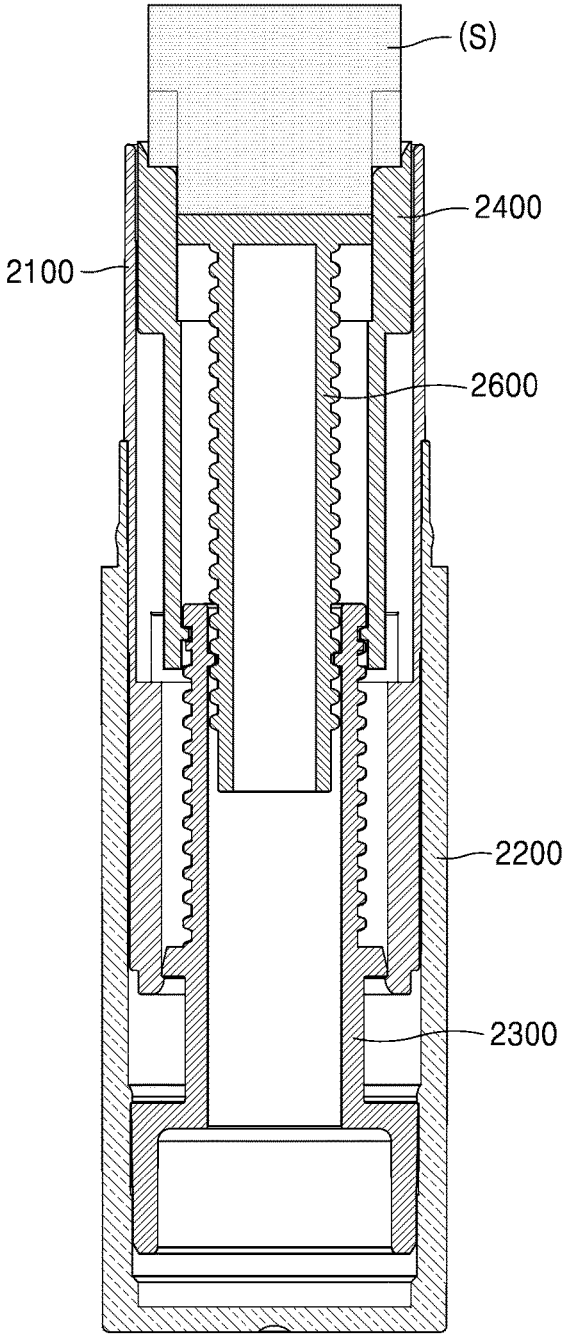

FIGS. 16A and 16B illustrate an example of using the container for stick type content according to the second embodiment of the present disclosure.

Referring to FIG. 16A, the user may move the first lifting portion 2400 and the second lifting portion 2600 upward simultaneously so as to expose content S outside the housing 2100.

That is, for example, when the user rotates the rotation portion 2200 in the first direction while gripping the housing 2100, the first lifting portion 2400 and the second lifting portion 2600 move upward to a certain height simultaneously so as to expose the content S outward through an outlet of the housing 2100 and to apply the content S exposed outward to an application region.

Meanwhile, when the user finishes using the content S and rotates the rotation portion 2200 in the second direction, the first lifting portion 2400 and the second lifting portion 2600 move downward simultaneously so that the content S is accommodated in the housing 2100.

Subsequently, referring to FIG. 16B, when a residual amount of the content S is small, the user may rotate the rotation portion 2200 further in the first direction and move the second lifting portion 2600 upward alone so as to expose the remaining content S outside the housing 2100. Accordingly, the user may use the content accommodated in the container 2000 for stick type content with little residue left.

According to the present disclosure, a container for stick type content is configured so that a first lifting portion and a second lifting portion move upward simultaneously and move content upward according to rotation of a manipulation portion. Here, when a certain height is reached, the second lifting portion moves upward alone and pushes up the content completely, all the content may be used without a residue.

As described above, optimum embodiments have been shown and described in the drawings and the specification. The particular terms used herein are merely intended to describe the present disclosure and are not used to limit the meanings or restrict the scope of the present disclosure disclosed in the claims. Therefore, it should be understood by one of ordinary skill in the art that a variety of modifications and equivalents thereof may be made. Accordingly, the technical scope of the present disclosure should be determined by the technical concept of the following claims.

What is claimed is:

1. A container for stick type content, comprising:

a housing having an outlet formed at an upper side thereof;

a manipulation portion coupled to a lower side of the housing to be relatively rotatable with the housing;

a first lifting portion provided inside the housing and comprising an accommodation portion on a top thereof, wherein the accommodation portion is configured to accommodate at least a part of the content; and a second lifting portion provided inside the first lifting portion and comprising a support portion disposed inside the accommodation portion to support the content from below, wherein the first lifting portion and the second lifting portion move upward or downward according to a rotation of the manipulation portion, and wherein the first lifting portion and the second lifting portion move upward simultaneously and are configured to move the content upward when the manipulation portion rotates in one direction while the second lifting portion moves upward alone and is configured to move the content further upward when the first lifting portion moves upward to a certain height.

2. The container of claim 1, wherein the first lifting portion and the second lifting portion are coupled to be synchronously rotatable.

3. The container of claim 1, wherein the accommodation portion comprises one or more fixing protrusions protruding inward from an inner surface of the accommodation portion while formed to have a certain length in a vertical direction, and the support portion comprises one or more incised grooves along a periphery thereof, and wherein the fixing protrusions are inserted into corresponding incised grooves so that the first lifting portion and the second lifting portion are coupled to be synchronously rotatable.

4. The container of claim 1, wherein a first guide protrusion is formed on an outer surface of the first lifting portion, and a second guide protrusion is formed on an outer surface of the second lifting portion, wherein the manipulation portion comprises:

a first lift pipe disposed to surround at least a part of the first lifting portion and comprising one or more first lift protrusions formed on an inner surface thereof; and a second lift pipe disposed between the first lifting portion and the second lifting portion to surround at least a part of the second lifting portion and comprising one or more second lift protrusions formed on an inner surface thereof, and wherein according to the rotation of the manipulation portion, the first lift protrusions move along the first guide protrusion and lift the first lifting portion, and the second lift protrusions move along the second guide protrusion and lift the second lifting portion.

5. The container of claim 4, wherein the manipulation portion further comprises:

a rotation portion coupled to a lower side of the housing and configured to relatively rotate with respect to the housing by a user;

a first driving portion coupled to an inside of the rotation portion to be synchronously rotatable and comprising the first lift pipe; and a second driving portion coupled to the inside of the rotation portion to be synchronously rotatable and comprising the second lift pipe inserted into the first lift pipe.

6. The container of claim 5, wherein the first driving portion further comprises a first base portion in which one or more first coupling protrusions are formed along an outer surface below the first lift pipe, and one or more second coupling protrusions are formed along an inner surface of the rotation portion, and wherein the first coupling protrusions and the second coupling protrusions are engaged with each other so that the first driving portion and the rotation portion are coupled to be synchronously rotatable.

7. The container of claim 5, wherein the second driving portion further comprises a second base portion formed outside a lower end of the first lift pipe, and one or more pressurizing protrusions are formed along an inner surface of the rotation portion, and wherein the pressurizing protrusions pressurize an outer surface of the second base portion so that the second driving portion and the rotation portion are coupled to be synchronously rotatable.

8. The container of claim 4, wherein one or more restriction protrusions configured to restrict an upward movement height of the first lifting portion are formed at positions spaced downward at a certain distance apart from a lower end of the first guide protrusion below the first lifting portion.

9. The container of claim 4, wherein the first lifting portion further comprises a first load portion extending toward a lower side of the accommodation portion, comprising the first guide protrusion formed on an outer surface thereof, and at least partially accommodated inside the first lift pipe, and wherein the second lifting portion further comprises a second load portion extending toward a lower side of the support portion, comprising the second guide protrusion formed on an outer surface thereof, and at least partially accommodated inside the second lift pipe.

10. The container of claim 1, wherein one or more first lift protrusions are formed on an inner surface of the first lifting portion, wherein the manipulation portion comprises a lift pipe disposed inside the first lifting portion to surround the second lifting portion and comprising a first guide protrusion formed on an outer surface thereof and one or more second lift protrusions formed on an inner surface thereof, wherein a second guide protrusion is formed on an outer surface of the second lifting portion, and wherein according to the rotation of the manipulation portion, the first lift protrusions move along the first guide protrusion and lift the first lifting portion, and the second lift protrusions move along the second guide protrusion and lift the second lifting portion.

11. The container of claim 10, wherein when the first lift protrusions are separated from an upper end of the first guide protrusion according to the rotation of the manipulation portion in the one direction, only the second lift protrusions move further along the second guide protrusion and move the second lifting portion alone upward.

12. The container of claim 10, wherein a first restriction protrusion spaced upward apart from an upper end of the first guide protrusion and configured to prevent separation of the first lifting portion is formed on an external upper end of the lift pipe along an outer circumferential surface thereof.

13. The container of claim 12, wherein a second restriction protrusion is further formed on the external upper end of the lift pipe along the outer circumferential surface thereof to be at least partially overlapped with the upper end of the first guide protrusion, wherein the second restriction protrusion is disposed below the first restriction protrusion to be spaced apart therefrom, and wherein according to the rotation of the manipulation portion in the first direction, the first lift protrusions move along the first guide protrusion and cross the second restriction protrusion to relatively rotate with the manipulation portion in a space between the first restriction protrusion and the second restriction protrusion, and the second lift protrusions move further along the second guide protrusion and lift the second lifting portion alone.

14. The container of claim 13, wherein the second restriction protrusion is formed to have a protruding height lower than the first guide protrusion.

15. The container of claim 10, wherein the first lifting portion further comprises a first load portion extending toward a lower side of the accommodation portion, comprising the first lift protrusions formed on an inner surface thereof, and at least partially accommodating the lift pipe thereinside, and wherein the second lifting portion further comprises a second load portion extending toward a lower side of the support portion, comprising the second guide protrusion formed on an outer surface thereof, and at least partially accommodated inside the lift pipe.

16. The container of claim 10, wherein the manipulation portion further comprises:

a rotation portion coupled to the lower side of the housing and configured to relatively rotate with respect to the housing according to manipulation of a user; and a driving portion coupled to an inside of the rotation portion to be synchronously rotatable and in which the lift pipe is formed.

* * * * *